US006932021B1

(12) United States Patent
Martini

(10) Patent No.: US 6,932,021 B1
(45) Date of Patent: Aug. 23, 2005

(54) DOCK SWIVEL STEP

(76) Inventor: Todd C. Martini, 25 Mercury Dr., Florissant, MO (US) 63031

( * ) Notice: Subject to any disclaimer, the term of this patent is extended or adjusted under 35 U.S.C. 154(b) by 9 days.

(21) Appl. No.: 10/943,260

(22) Filed: Sep. 17, 2004

(51) Int. Cl.[7] ..... B63B 17/00
(52) U.S. Cl. ..... 114/362; 297/91
(58) Field of Search ..... 114/362; 297/127, 297/89, 90–92, 100

(56) References Cited

U.S. PATENT DOCUMENTS

| | | | | |
|---|---|---|---|---|
| 3,033,309 A | * | 5/1962 | Fugere | 182/90 |
| 3,825,097 A | * | 7/1974 | Owen | 182/91 |
| 3,908,794 A | * | 9/1975 | Stone | 182/91 |
| 4,524,475 A | * | 6/1985 | Valentino | 5/507.1 |
| 4,542,805 A | | 9/1985 | Hamlin | |
| 5,014,640 A | * | 5/1991 | Owen, Sr. | 114/362 |
| 5,515,806 A | * | 5/1996 | McCabe | 114/362 |
| 5,927,433 A | | 7/1999 | Jaramillo | |
| 6,170,093 B1 | | 1/2001 | Kowalski | |
| 6,425,711 B1 | | 7/2002 | Kiter | |

* cited by examiner

*Primary Examiner*—Ed Swinehart
(74) *Attorney, Agent, or Firm*—Don W. Weber

(57) ABSTRACT

A dock swivel step is attached to a dock pole by clamps. The swivel step has vertical outer and inner tubes. The vertical tube is clamped to the dock pole. An inner L shaped tube slides inside the outer tube. Attached to the horizontal part of the inner tube is an outer tube. The outer tube is attached to a bracket which in turn is attached to the dock step. The step is biases away from the dock and has a slot near the dock side of the step. The inner vertical and horizontal tube has an angle bracket which receives the slot the dock step to secure it in the horizontal and deployed position. In order to remove the dock step, one simply pulls the step slot away from the angle and pulls the step in the vertical position. The inner tube can then be rotated to a position where the step is vertical and parallel to the dock and in an un-deployed position.

3 Claims, 4 Drawing Sheets

DOCK SWIVEL STEP

BACKGROUND OF THE INVENTION

This invention relates to the field of water sports and docking boats. More particularly, a swivel step for a dock is presented which may be retracted.

In the field of water sports, the boat is commonly docked or tied to a horizontal dock permanently attached to the land. However, there is a space between the boat and the permanently attached dock. Dock steps have been devised to allow easier ingress or egress between the boat and the dock. In addition, planks, boards, and other devices are known in the art for allowing safe access between the boat and the dock.

Several devices have been disclosed which, in combination, allow access between a dock and a floating boat. For example, see the 2002 U.S. patent issued to Kiter, U.S. Pat. No. 6,425,711 B1. Kiter disclosed a combination step and ramp apparatus for boaters. However, Kiter is a complicated mechanical device and utilizes many parts. The Kiter step would be difficult to store because of its size. It is an object of this invention to provide a compact retractable step for use between a dock and a boat.

Several different types of platforms have been developed for use in and around water. An example of a retractable platform for a swimming pool is found in the 2001 U.S. patent issued to Kowalski, U.S. Pat. No. 6,170,093 B1. Kowalski utilizes a pair of bracket members which are mounted on the deck of a swimming pool and which allow access to the swimming pool. Again, the Kowalski retractable platform must be permanently affixed to the side of the swimming pool and is not easily retractable and put out of the way. Removing the step from the path of the boat is an important feature of any boat-dock platform. It is another object of this invention to provide a platform swivel step to allow safe and easy ingress and egress between a boat and dock that is retractable.

In the boating industry, and particularly when it comes to docking a boat, it is necessary to provide a step that can be easily and quickly removed and placed in position where it will not damage the boat as it arrives. While the boat is completing the docking procedure, it would be unwise to have a horizontal protrusion, such as a horizontal step, to be between the dock and the boat. It is a still further object of this invention to provide a horizontal step between a dock and a boat which may be easily and readily repositioned to the vertical and retracted position.

Other and further objects of this invention will become apparent upon reading the below described specification.

BRIEF DESCRIPTION OF THE INVENTION

A retractable swivel boat dock step is provided. The step has an outer tube clamped onto the vertical post of a boat dock. The outer tube contains an inner vertical tube which has a horizontal leg attached at its bottom. The vertical and horizontal inner tubes are braced by a forty-five degree angle brace. A spring loaded and retractable step is attached to a lower, outer horizontal tube which slides inside the inner horizontal tube. Since the step is spring loaded, it may be placed in either the horizontal or the vertical position. The entire inner tubing may be rotated ninety degrees to position the step parallel to the dock and out of the way of the arriving and departing boat.

BRIEF DESCRIPTION OF THE DRAWING FIGURES

DETAILED DESCRIPTION OF THE PREFERRED EMBODIMENT

Figure 1:
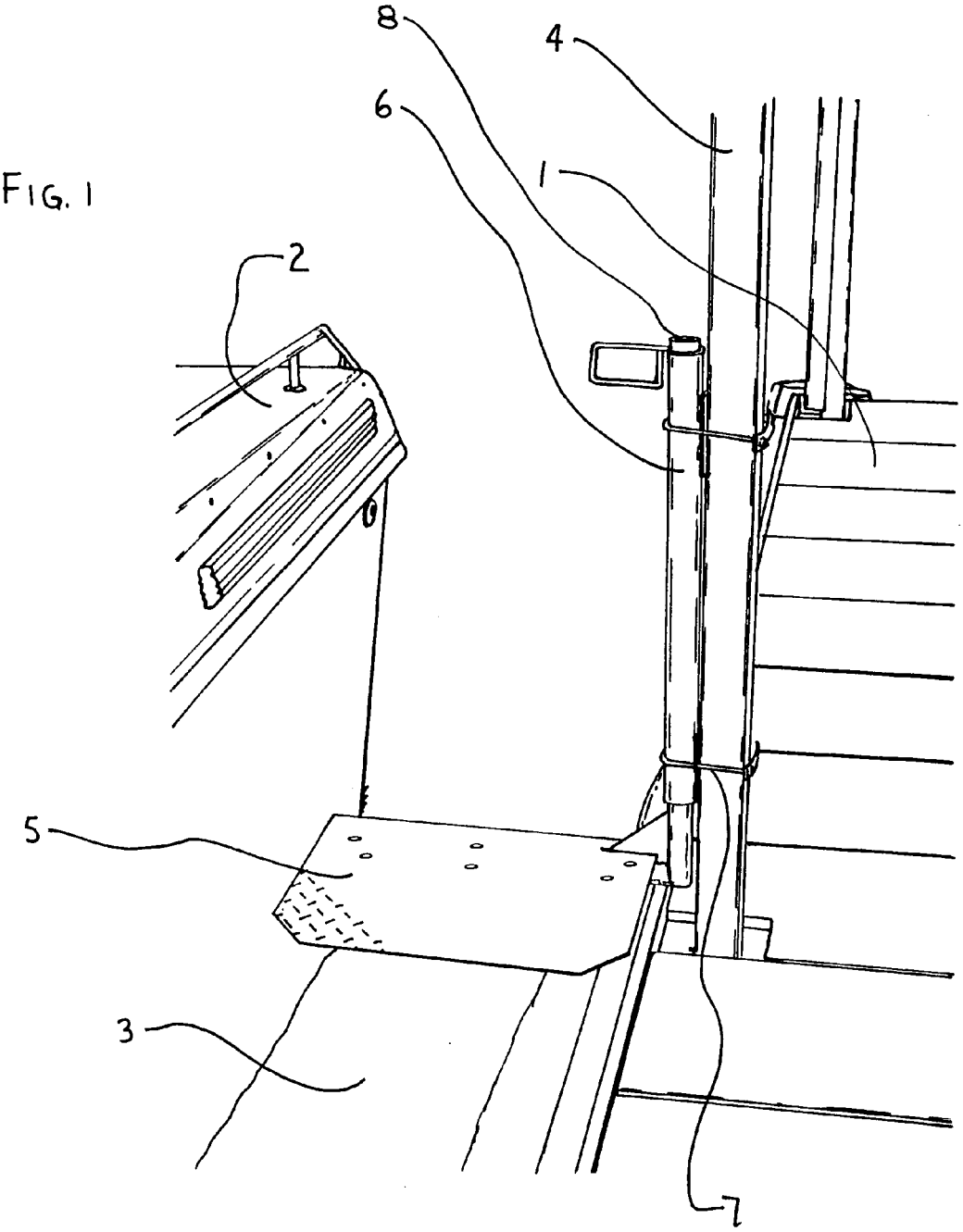
FIG. 1 is a perspective view of the swivel boat dock step, including a boat and a dock.

A dock 1 is shown with an adjacent boat 2. When the boat 2 is docked, the side of the boat and the dock are essentially parallel. However, there remains a gap 3 of water between the dock and boat as best shown in FIG. 1. Standard docks usually have at least one vertical post or pole 4. The dock swivel step is attached to this vertical dock pole. The dock swivel step 5, shown in its horizontal and deployed position in FIG. 1, is a spring-loaded mechanism that may be in either the horizontal or vertical position.

Figure 6:
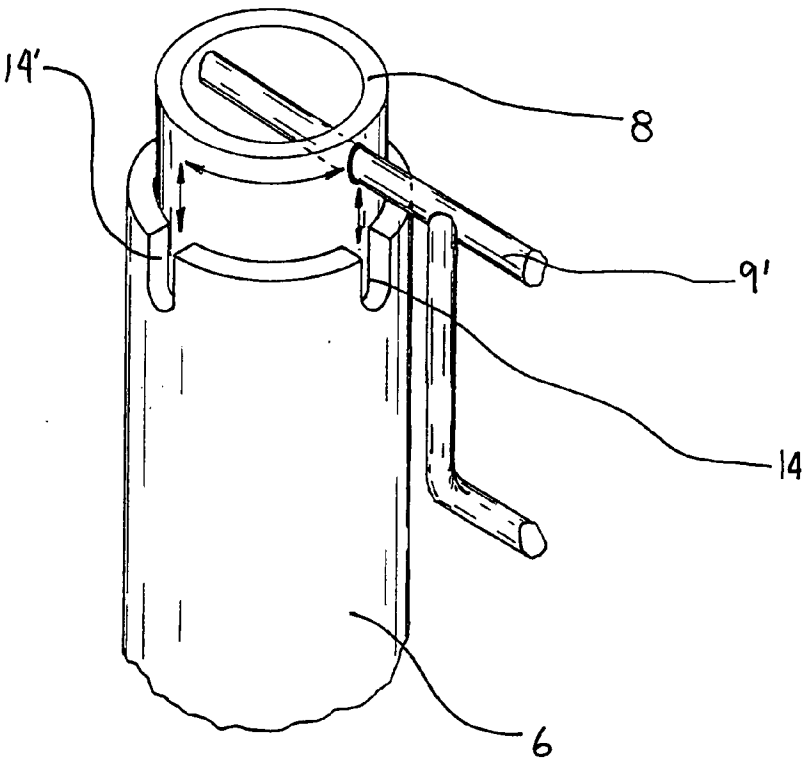
FIG. 6 is a perspective view of the upper part of the dock swivel step apparatus, showing the mechanism used to swivel the step ninety degrees parallel to the dock.

The attaching mechanism of the dock swivel step includes a vertical outer tube 6 which is secured to the vertical dock post 4 by clamps 7. This main step support tube 6 is constructed of one and a quarter inch Schedule 40 steel pipe which is twenty four inches long and is attached to the existing support with two two and half inch U-bolts welded to a pipe with two inch by four inch flat steel backers. The top of the main support tube 6 is notched at ninety degrees, as best shown in FIG. 6.

Figure 2:
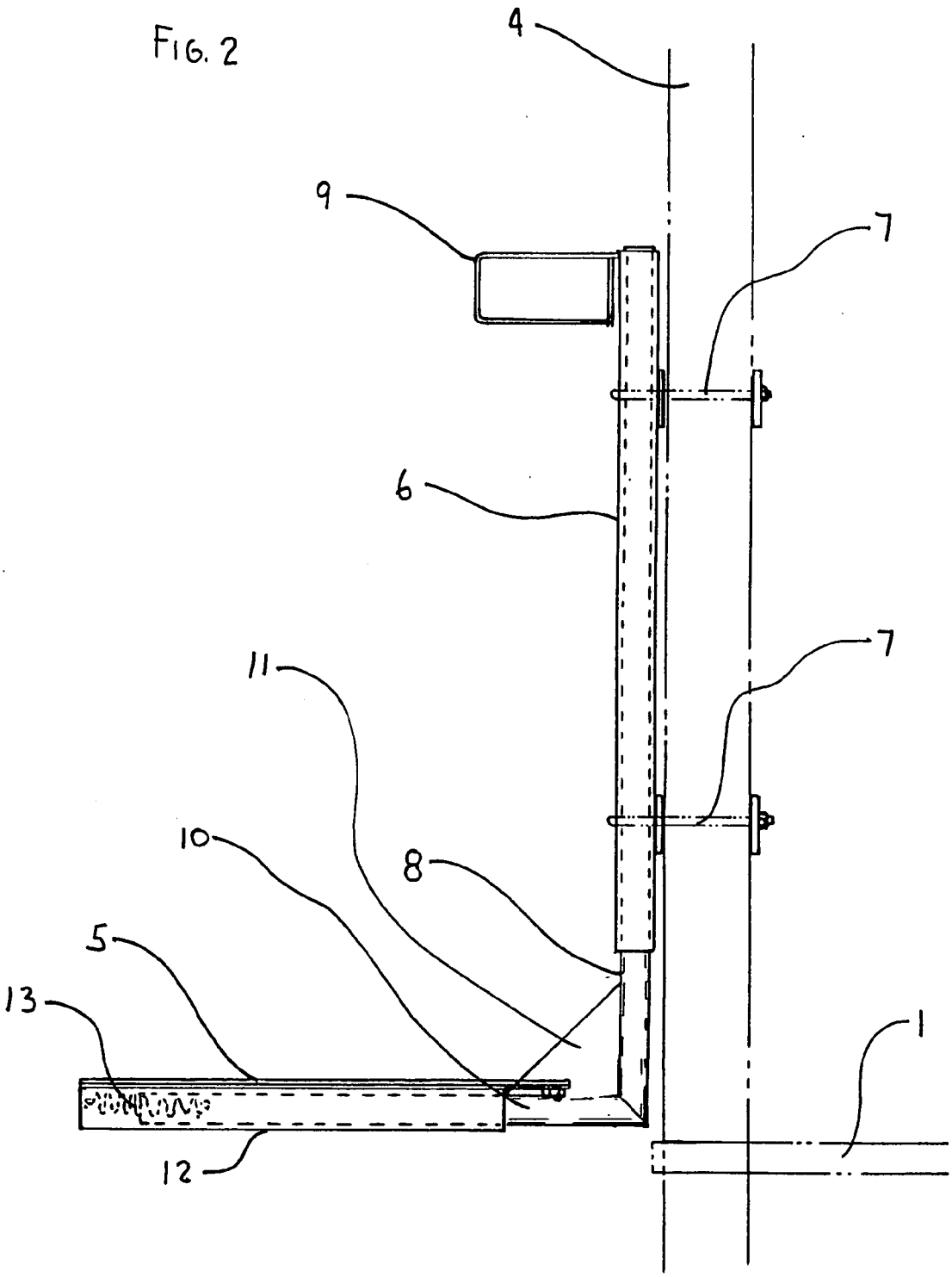
FIG. 2 is a view similar to that of FIG. 1, showing the mechanical elements and attachment of the swivel boat dock step.
Figure 3:
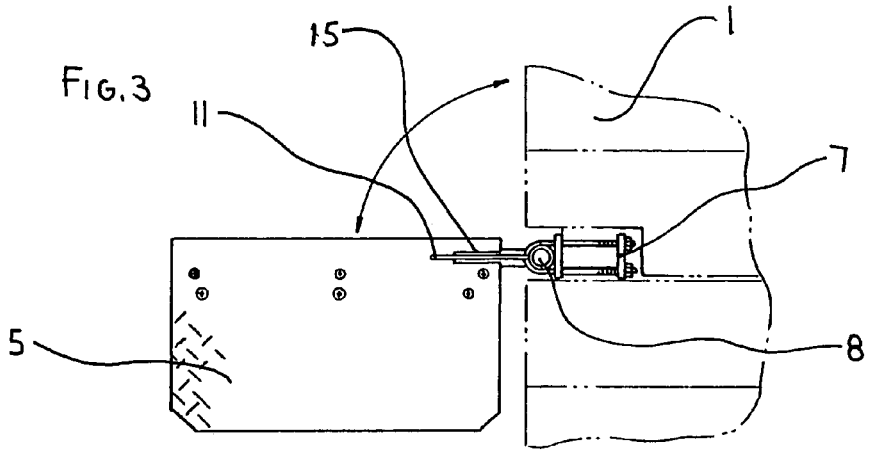
FIG. 3 is a top view of the dock swivel step.
Figure 4:
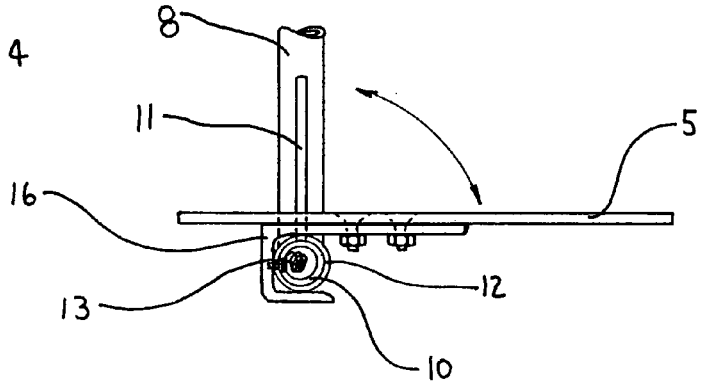
FIG. 4 is front end view of the dock swivel step showing the mechanism which allows the step to be raised to the vertical position.

Turning now to FIG. 2, the mechanism of the dock swivel step is shown. Slideable and rotatable inside the outer vertical tube 6 is an inner vertical tube 8. The inner vertical tube 8 has a handle 9 that is attached to the top of the inner vertical tube 8. This handle 9 may be square shaped, or may be made of a single horizontal piece. The square swivel handle 9 shown in FIG. 2 has a handle horizontal piece 9' which fits into notches 14 as shown on FIG. 6. The use of the notches is explained further below.

Permanently attached at the bottom of the inner vertical tube 8 is an inner horizontal tube 10. The vertical 8 and horizontal 10 tubes may be attached by welding or similar methods. The inner tubes are perpendicular when attached together. To make the step unit stronger, and to lock the swivel step 5 in its horizontal deployment, an inner tube angle brace 11, as best shown in FIG. 2, is welded to the vertical and horizontal inner tubes. The angle brace is attached to the bottom of the inner vertical tube and to the horizontal tube as shown.

As shown in FIGS. 2 through 5, the swivel step 5 is attached by bolts to a lower step moveable plate 16. This lower step moveable plate 16 has a generally L-shaped configuration as best shown on FIG. 4. The lower step moveable plate 16 is permanently attached to an outer horizontal tube 12. This outer horizontal tube 12 slides on the outside of the inner horizontal tube 10 as shown. The step is slidably attached to the lower inner horizontal tube by these elements.

It is important that the swivel step 5 remain biased towards the vertical tubes 6 and 8 when in the horizontal and deployed position. In order to bias the step 5 towards the inner vertical tube 8, a biasing spring 13 is attached to the inner horizontal tube 10 and to the outer horizontal tube 12 in the preferred embodiment.

Figure 5:
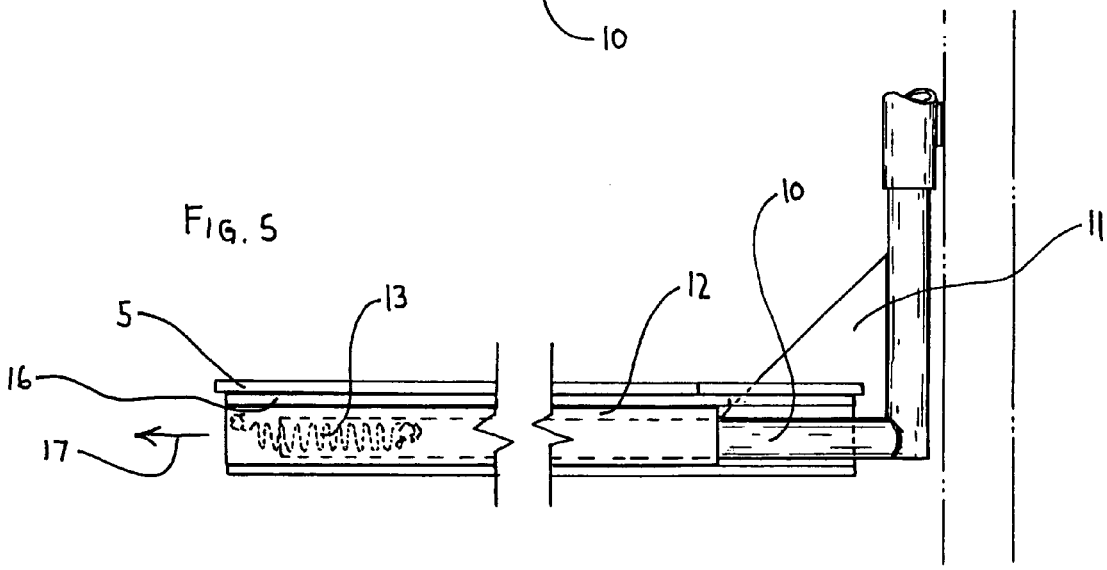
FIG. 5 is a side view of the dock swivel step showing the mechanism used to raise the swivel step to the vertical position.

As shown in FIGS. 2 and 5, the biasing spring 13 may be attached near the boat side of the swivel step. However, the exact placement of the biasing spring may be varied. For example, in a second embodiment, the biasing spring may be attached near the dock side of the swivel step. In this second embodiment, the spring would have one end attached to the inner horizontal tube 10 and another end attached to the outer horizontal tube 12. The spring would thus bias the swivel step 5 towards the right, or towards the dock, in FIGS. 2 and 5. Biasing the step to the right as shown in FIGS. 2 and 5 maintains the step in the horizontal and deployed position. Different placements of the biasing spring are well within the spirit of this disclosure, as long as the step 5 is biased towards the dock side of the unit.

In FIGS. 1 and 2, the swivel step 5 is in its horizontal and deployed position. In this position, a slot 15 in the step 5 (best shown in FIGS. 3 and 7) maintains the step in the horizontal and locked position. The slot 15 is adapted to accept the angle vertical brace 11. This holds the step horizontally in place. In order to raise the step to the vertical position, the step 5 (attached to the moveable plate 16 that is also attached to the outer horizontal tube 12) must be moved in the direction of the arrow 17 (away from the dock) as shown on FIG. 5. The movement of the step 5 in the direction of the arrow 17 allows the slot 15 to become disengaged from the inner tube vertical brace 11. The step 5 may then be rotated upwards to the vertical position. In this position, the step 5 is parallel to the inner tube vertical brace 11. The entire step may then be rotated ninety degrees as described below.

As best shown in FIG. 6, the swivel step 5 may be rotated ninety degrees clockwise such that the step 5 is parallel to the dock 1 and the boat 2. The upper part of the outer vertical tube 6 has two notches 14 and 14' located ninety degrees apart. A first notch 14, positioned perpendicular to the dock, allows the step to be positioned perpendicular to the dock and boat, shown in its perpendicular and deployed position in FIGS. 1, 2, 3, and 5.

Figure 7:
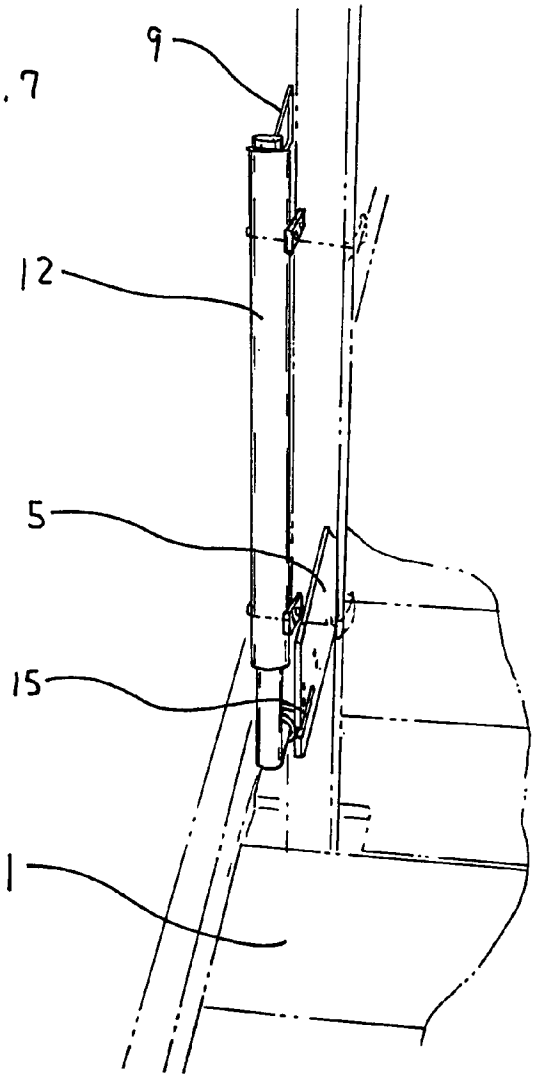
FIG. 7 is a perspective view of the dock swivel step in its vertical and un-deployed position.

A second notch is located parallel to the dock. To position the step 5 parallel to the dock, the inner vertical tube 8 may be raised such that the handle 9 and inner vertical tube 8 are rotated ninety degrees, parallel to the dock. When the inner tube and step are rotated ninety degrees clockwise, the upper handle horizontal piece 9' is positioned in the undeployed parallel notched position 14'. In this undeployed position, the dock swivel step 5 is vertical and parallel to both the boat dock and the boat, as shown in FIG. 7.

It has been found that this vertical, parallel and undeployed position keeps the dock swivel step away from the boat when it is docking or landing and also provides a measure of safety for the occupants of the boat when they are departing from the dock.

The dock swivel step unit is constructed out of steel and aluminum tread plate. In the preferred embodiment, the vertical height of the dock swivel step unit is approximately thirty inches (main vertical tube), while the horizontal measurement of the foot step itself is approximately eighteen inches in length and twelve inches wide. The swivel step 5 may be made of aluminum tread plate which is approximately twelve inches wide, eighteen inches long and one fourth inch thick. The step may have a tread or cross-hatched pattern on its top face for safety.

The tread plate is attached to the top of angle iron (referred to in this Specification as the lower step moveable plate 16). The angle iron is preferably made of five inch by three inch by one-quarter inch angle iron that is eighteen inches long. The angle iron moveable plate 16 is welded to a one and a quarter inch sleeve pipe (outer horizontal tube 12) that is approximately eighteen inches long. The tread plate 5 is secured to the angle iron moveable plate 16 by counter sunk three-eighth inch bolts.

The step 5 has a ninety-degree slot 15 which is approximately four inches deep. This ninety degree slot 15 catches and locks on the four inch angle plate 11. In the preferred embodiment, the internal spring is four inches by three-eighth inches and biases the step 5 towards the dock as previously described.

The inner tubes 8 and 10 are preferably made of one inch Schedule 40 steel pipe, with the vertical inner tube 8 being approximately thirty inches long and the horizontal inner tube 10 being sixteen inches long. The inner tubes 8 and 10 have ninety-degree welds and contain a four-inch flat plate 11, as shown in the drawing figures.

For support and to provide a locking mechanism for the swivel step, the thirty inch inner vertical tube 8 is sleeved into the main outer support tube 6. The main outer support tube 6 has a three-eighth inch thick handle welded into the top. The notches 14 and 14' are approximately three-eighths inches in depth.

The above dimensions and metals are set out as the preferred method and embodiment of this swivel step unit. They are meant as an illustration only and not as a limitation. Obviously, variations of the metals, dimensions and placements of some of the parts are still within the spirit and disclosure of this invention.

In order to attach the dock swivel step to the dock, the main outer vertical tube 6 is simply clamped to the dock pole 4 as shown. The main vertical outer tube 6 should have the deployed notch 14 facing between the dock and the boat so that the swivel step 5, in its deployed position, is perpendicular to the dock and the boat. With the main vertical outer tube 6 clamped in this position, the un-deployed or folded up notch 14' is then at ninety degrees clockwise to the dock and boat position.

In order to deploy the swivel step 5, one simply pulls up on the handle 9 and rotates the inner vertical tube 8 to the deployed notch position as shown in FIGS. 1 and 6. Once the step is perpendicular to the dock and boat, the step is pulled towards the boat 5 and rotated to the horizontal position. The swivel step slot 15 is then positioned around the inner tube vertical brace 11 and the step 5 is placed in the horizontal and deployed position. The reverse procedure is used to reposition the step to the vertical and docked, parallel undeployed position shown in FIG. 7.

Having fully described my invention, I claim:

1. A swivel step for a boat dock, comprising:

(a) a vertical outer tube attached to a pole of a boat dock;

(b) an inner vertical tube slidably positioned inside of said vertical tube;

(c) a lower, inner horizontal tube perpendicular and attached to the bottom of said inner vertical tube;

(d) an angle brace attached at the bottom of said inner vertical tube and to said inner horizontal tube;

(e) a step having a slot adapted to receive said angle brace, said step slidably attached to said lower, inner horizontal tube and biased towards said inner vertical tube;

wherein said step may be positioned in a horizontal or vertical direction.

2. A swivel step for a boat dock as in claim 1, wherein the upper part of said outer vertical tube has one notch perpendicular to said dock and one notch parallel to said dock, further comprising a handle attached to said inner vertical tube, whereby said step may be positioned perpendicular to said dock or rotated so that it is parallel to said dock.

3. A swivel step for a boat dock as in claim 1, wherein said step is crosshatched for safety.

* * * * *